US008399393B2

(12) United States Patent
Miralles

(10) Patent No.: US 8,399,393 B2
(45) Date of Patent: Mar. 19, 2013

(54) COMBINATION OF SOLUBLE LITHIUM SALT AND SOLUBLE ALUMINUM OR SILICATE SALT AS A GLASS ETCHING INHIBITOR

(75) Inventor: Altony Miralles, Woodbury, MN (US)

(73) Assignee: Ecolab USA Inc., St. Paul, MN (US)

( * ) Notice: Subject to any disclaimer, the term of this patent is extended or adjusted under 35 U.S.C. 154(b) by 68 days.

(21) Appl. No.: 12/772,394

(22) Filed: May 3, 2010

(65) Prior Publication Data

US 2011/0269660 A1 Nov. 3, 2011

(51) Int. Cl.
*C11D 7/10* (2006.01)
*C11D 7/14* (2006.01)

(52) U.S. Cl. ..... 510/220; 510/224; 510/225; 510/227; 510/232; 510/233

(58) Field of Classification Search ..... 510/220, 510/224, 225, 227, 232, 233
See application file for complete search history.

(56) References Cited

U.S. PATENT DOCUMENTS

| | | | | |
|---|---|---|---|---|
| 3,048,548 | A | 8/1962 | Martin et al. | |
| 3,334,147 | A | 8/1967 | Brunelle et al. | |
| 3,442,242 | A | 5/1969 | Laskey et al. | |
| 4,426,362 | A | 1/1984 | Copeland et al. | |
| 4,486,547 | A | 12/1984 | Imai et al. | |
| 4,618,914 | A | 10/1986 | Sato et al. | |
| 4,687,121 | A | 8/1987 | Copeland | |
| 4,690,305 | A | 9/1987 | Copeland | |
| RE32,763 | E | 10/1988 | Fernholtz et al. | |
| RE32,818 | E | 1/1989 | Fernholz et al. | |
| 4,826,661 | A | 5/1989 | Copeland et al. | |
| 4,830,773 | A | 5/1989 | Olson | |
| 4,859,358 | A * | 8/1989 | Gabriel et al. | 510/222 |
| 5,164,106 | A * | 11/1992 | Ahmed et al. | 510/221 |
| 5,229,027 | A * | 7/1993 | Ahmed | 510/221 |
| 5,683,975 | A | 11/1997 | Skodell et al. | |
| 5,763,386 | A | 6/1998 | Mondin et al. | |
| 6,150,624 | A | 11/2000 | Yao | |
| 6,156,715 | A | 12/2000 | Lentsch et al. | |
| 6,164,296 | A | 12/2000 | Lentsch et al. | |
| 6,177,392 | B1 | 1/2001 | Lentsch et al. | |
| 6,235,688 | B1 | 5/2001 | Small et al. | |
| 6,258,765 | B1 | 7/2001 | Wei et al. | |
| 6,369,021 | B1 | 4/2002 | Man et al. | |
| 6,410,495 | B1 | 6/2002 | Lentsch et al. | |
| 7,033,980 | B2 | 4/2006 | Waits et al. | |
| 7,087,662 | B2 | 8/2006 | Ghosh et al. | |
| 7,135,448 | B2 | 11/2006 | Lentsch et al. | |
| 7,196,045 | B2 | 3/2007 | Lentsch et al. | |
| 7,749,329 | B2 * | 7/2010 | Smith et al. | 134/18 |
| 2004/0121926 | A1 * | 6/2004 | Waits et al. | 510/221 |
| 2009/0131297 | A1 * | 5/2009 | Smith | 510/224 |
| 2010/0105597 | A1 | 4/2010 | Harrington et al. | |

FOREIGN PATENT DOCUMENTS

| | | | |
|---|---|---|---|
| DE | 4307473 | A1 | 9/1994 |
| JP | 09283479 | A | 10/1997 |
| WO | WO0216535 | A2 | 2/2002 |
| WO | WO2006037002 | A1 | 4/2006 |

OTHER PUBLICATIONS

International Search Report and Written Opinion, PCT/IB2011/051913 (Feb. 28, 2012).

* cited by examiner

*Primary Examiner* — Charles Boyer
(74) *Attorney, Agent, or Firm* — Andrew D. Sorensen; Amy J. Hoffman

(57) ABSTRACT

A warewashing detergent composition is provided including an alkalinity source, a corrosion inhibitor and optionally, a cleaning agent. The glass corrosion inhibitor includes at least a soluble lithium salt and optionally includes a soluble aluminum salt and/or a soluble silicate salt. The warewashing detergent composition has a pH of at least about 8.

22 Claims, No Drawings

COMBINATION OF SOLUBLE LITHIUM SALT AND SOLUBLE ALUMINUM OR SILICATE SALT AS A GLASS ETCHING INHIBITOR

TECHNICAL FIELD

The present invention relates generally to the field of warewashing compositions. In particular, the present invention is a warewashing composition including a corrosion inhibitor to reduce corrosion and/or etching of glass, methods of manufacturing the warewashing composition and methods of using the warewashing compositions.

BACKGROUND

Glassware that is repetitively washed in automatic dishwashing machines have a tendency to develop a surface cloudiness that is irreversible. The surface cloudiness is believed to be a type of etching or corrosion of the glass and often manifests itself as an iridescent film that displays rainbow hues when light is reflected off of the surface of the glass. As the glass is repeatedly washed, the surfaced progressively becomes more opaque. This same type of corrosion is seen on other articles that are washed in automatic dishwashing machines including, but not limited to: china, porcelain, and ceramics.

It is believed that the corrosion or etching of the glassware actually relates to two separate phenomena: the first is due to minerals leaching out from the glass composition together with the silicate network hydrolyzing and the second is silicate material depositing and redepositing onto the glass. It is a combination of the two phenomena that can result in the cloudy appearance of glassware that has been repeatedly washed in automatic dishwashers.

SUMMARY

In one embodiment, the present invention is a warewashing detergent composition including an alkalinity source, a corrosion inhibitor and optionally, a cleaning agent. The corrosion inhibitor includes at least a soluble lithium salt and optionally includes a soluble aluminum salt and/or a soluble silicate salt. The warewashing detergent composition has a pH of at least about 8. If a soluble aluminum salt is present, the soluble aluminum salt and the soluble lithium salt may be present in an amount sufficient to provide a weight ratio of soluble aluminum salt to soluble lithium salt of between about 410:1 and about 1:10. If a soluble silicate salt is present, the soluble silicate salt and the soluble lithium salt may be present in an amount sufficient to provide a weight ratio of soluble silicate salt to soluble lithium salt of between about 40:1 and about 1:40. If a soluble aluminum salt and a soluble silicate salt are present, the soluble aluminum salt, the soluble silicate salt, and the soluble lithium salt may be present in an amount sufficient to provide a weight ratio of soluble aluminum salt to soluble silicate salt to soluble lithium salt of between about 10:40:1 and about 4:1:40.

In another embodiment, the present invention is a corrosion inhibitor including a soluble lithium salt and at least one of a soluble aluminum salt and a soluble silicate salt. If a soluble aluminum salt is present, the soluble aluminum salt and the soluble lithium salt may be present in an amount sufficient to provide a weight ratio of soluble aluminum salt to soluble lithium salt of between about 410:1 and about 1:10. If a soluble silicate salt is present, the soluble silicate salt and the soluble lithium salt may be present in an amount sufficient to provide a weight ratio of soluble silicate salt to soluble lithium salt of between about 40:1 and about 1:40. If a soluble aluminum salt and a soluble silicate salt are present, the soluble aluminum salt, the soluble silicate salt, and the soluble lithium salt may be present in an amount sufficient to provide a weight ratio of soluble aluminum salt to soluble silicate salt to soluble lithium salt of between about 10:40:1 and about 4:1:40.

In yet another embodiment, the present invention is a method for using a warewashing detergent composition. The method includes diluting the warewashing detergent composition with water at a dilution ratio of at least about 20:1 water to warewashing detergent composition to form a use solution and washing ware with the use solution in an automatic dishwashing machine. The warewashing detergent composition includes a cleaning agent, an alkalinity source and a corrosion inhibitor in an amount sufficient to reduce corrosion and/or etching of glass. The corrosion inhibitor comprising a soluble lithium salt and at least one of an soluble aluminum salt and a soluble silicate salt in the amounts specified above.

In yet another embodiment, the present invention is a product formed by mixing a soluble lithium salt and at least one of a soluble aluminum salt and a soluble silicate salt to form a corrosion inhibitor and adding the corrosion inhibitor to a detergent including an alkalinity source. If a soluble aluminum salt is present, the soluble aluminum salt and the soluble lithium salt may be present in an amount sufficient to provide a weight ratio of soluble aluminum salt to soluble lithium salt of between about 410:1 and about 1:10. If a soluble silicate salt is present, the soluble silicate salt and the soluble lithium salt may be present in an amount sufficient to provide a weight ratio of soluble silicate salt to soluble lithium salt of between about 40:1 and about 1:40. If a soluble aluminum salt and a soluble silicate salt are present, the soluble aluminum salt, the soluble silicate salt, and the soluble lithium salt may be present in an amount sufficient to provide a weight ratio of soluble aluminum salt to soluble silicate salt to soluble lithium salt of between about 10:40:1 and about 4:1:40.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

The present invention provides a warewashing composition for protecting articles such as glassware from corrosion during automatic dishwashing or warewashing. The warewashing composition includes a corrosion inhibitor that reduces the amount of etching on the surface of glassware caused by the alkalinity of the warewashing detergent when being washed, thus extending the lifetime of the glassware. Although the warewashing composition is primarily discussed as being used in conjunction with an automatic dishwashing or warewashing process, the warewashing composition can also be referred to as a cleaning composition and can be used for cleaning in other environments and processes. For example, the warewashing or cleaning composition may be used in any situation reduction of glassware etching is desired.

The warewashing composition includes a corrosion inhibitor, an alkalinity source and optionally, a cleaning agent. In one embodiment, the corrosion inhibitor includes at least a soluble lithium salt. The soluble lithium salt provides lithium ions when the warewashing composition is provided in the form of a use solution. The soluble lithium salt can be provided as an organic salt, inorganic salt or mixtures thereof. Exemplary sources of soluble lithium salts include, but are not limited to: lithium hydroxide, lithium silicate, lithium metasilicate, lithium chloride, lithium sulfate, lithium nitrate, lithium iodide, lithium thiocyanate, lithium fluosilicate, lithium dichromate, lithium chlorate, sodium lithiumate, lithium gluconate, lithium acetate, lithium benzoate, lithium citrate, lithium lactate, lithium formate, lithium bromate, lithium bromide, lithium fluoride, lithium fluorosilicate and lithium salicylate.

In another embodiment, the corrosion inhibitor includes a soluble lithium salt and a soluble aluminum salt and/or a soluble silicate ($SiO_2$) salt. The soluble aluminum salt and soluble silicate salt provide aluminum ions and silicate ions, respectively, when the warewashing composition is provided in the form of a use solution. The soluble aluminum salt can be provided as an organic salt, inorganic salt or mixtures thereof. Exemplary soluble aluminum salts include, but are not limited to: sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulphate, aluminum phosphate and aluminum lithium sulfate. The soluble silicate salt can be provided as a soluble inorganic salt. Exemplary soluble silicate salts include, but not limited to: lithium silicate, lithium metasilicate, sodium metasilicate, potassium metasilicate, sodium orthosilicate, and potassium orthosilicate.

The corrosion inhibitor includes an effective amount of soluble lithium salt, soluble aluminum salt and/or soluble silicate salt to provide a use solution exhibiting resistance to glass corrosion and/or etching. The warewashing composition that contacts the articles to be washed in an automatic dishwashing or warewashing process can be referred to as the use solution. The amounts of soluble lithium salt and soluble aluminum salt and/or a soluble silicate salt can be characterized as effective when present in amounts sufficient to provide a use solution exhibiting a rate of corrosion and/or etching of glass that is less than the rate of corrosion and/or etching of glass for an otherwise identical use solution except for the absence of the corrosion inhibitor. The combination of the soluble lithium salt and soluble aluminum salt and/or a soluble silicate salt can be characterized as a synergistic combination when the improvement in corrosion and/or etching resistance is greater than the expected cumulative effect of the soluble lithium salt and soluble aluminum salt and/or a soluble silicate salt.

When at least two components are included in the corrosion inhibitor, it is possible to provide reduced corrosion and/or etching of glassware and ceramics by controlling (1) the ratio of soluble aluminum salt to soluble lithium salt in the use solution, (2) the ratio of soluble silicate salt to soluble lithium salt in the use solution or (3) the ratio of soluble aluminum salt to soluble silicate salt to soluble lithium salt in the use solution. That is, the combination of the soluble lithium salt and the soluble aluminum salt and/or soluble silicate salt provides a reduction of corrosion and/or etching of glass such that the amount of corrosion and/or etching is less than when any of the components are used individually. In one embodiment, the weight ratio of soluble aluminum salt to soluble lithium salt in the use solution is between about 410:1 and about 1:10 and particularly between about 4:1 and about 1:4. In one embodiment, the ratio of the soluble lithium salt to soluble silicate salt is between about 1:40 and about 40:1. In an exemplary embodiment in which the salts are sodium aluminate and lithium silicate, the soluble aluminum salt, soluble silicate salt, and soluble lithium salt also act synergistically at ratios of between about 10:40:1 and about 4:1:40.

When more than one salt is present in the corrosion inhibitor, the amount of the corrosion inhibitor is calculated based upon the combined amount of soluble lithium salt and soluble aluminum salt and/or a soluble silicate salt. In one embodiment, the use solution includes at least about 0.04 ppm of the corrosion inhibitor. In particular, the use solution includes between about 0.01 ppm and about 300 ppm of the corrosion inhibitor and more particularly between about 0.01 ppm and about 200 ppm of the corrosion inhibitor. In the case of a concentrate that is intended to be diluted to a use solution, the corrosion inhibitor is provided at a concentration of between about 0.1% by weight and about 2.5% by weight and particularly between about 0.5% by weight and about 2% by weight of the total weight of the warewashing composition.

The warewashing composition includes an effective amount of one or more alkalinity sources, such as an alkali metal hydroxide, alkali metal carbonate, or alkali metal silicate, to enhance cleaning and improve soil removal performance of the warewashing composition. In general, it is expected that the warewashing composition will include the alkalinity source in an amount of between about 5% and 75% by weight, between about 10% and 60% by weight, or between about 15% and 40% by weight. In some embodiments, the alkalinity source can be provided in the concentrate in an amount of less than about 30% by weight or less than about 20% by weight.

Examples of suitable alkalinity sources include, but are not limited to: sodium hydroxide, potassium hydroxide, sodium carbonate, potassium carbonate or a mixture of alkali metal hydroxide and alkali metal carbonate. Examples of particularly suitable alkalinity sources include, but are not limited to: sodium carbonate, sodium hydroxide, or a mixture of sodium carbonate and sodium hydroxide. The alkalinity source controls the pH of the resulting solution when water is added to the cleaning composition to form a use solution. The pH of the cleaning composition must be maintained in the alkaline range in order to provide sufficient detergency properties. In an exemplary embodiment, the pH of the cleaning composition is between approximately 8 and approximately 10. If the pH of the cleaning composition is too high, for example, above approximately 12, the warewashing composition may become too alkaline and begin to attack the surface to be cleaned. In some circumstances, the warewashing composition may provide a use composition that is useful at pH levels below about 8. In such compositions, the alkaline source may be omitted, and alternative pH adjusting agents may be used to provide the use composition with the desired pH.

The warewashing composition may optionally include at least one cleaning agent including a surfactant or surfactant system. However, surfactants are an optional component of the warewashing composition and can be excluded from the concentrate. When a surfactant is included, a variety of surfactants can be used in the warewashing composition, including, but not limited to: anionic, nonionic, cationic, and zwitterionic surfactants. Exemplary surfactants that can be used are commercially available from a number of sources. For a discussion of surfactants, see Kirk-Othmer, Encyclopedia of Chemical Technology, Third Edition, volume 8, pages 900-912. When the warewashing composition includes a cleaning agent, the cleaning agent is provided in an amount effective to provide a desired level of cleaning The warewashing composition, when provided as a concentrate, can include the cleaning agent in a range of about 0.05% to about 20% by weight, about 0.5% to about 15% by weight, about 1% to about 15% by weight, about 1.5% to about 10% by weight, and about 2% to about 8% by weight. Additional exemplary ranges of surfactant in a concentrate include about 0.5% to about 8% by weight, and about 1% to about 5% by weight.

Examples of anionic surfactants useful in the warewashing composition include, but are not limited to: carboxylates such as alkylcarboxylates and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters; sulfates such as sulfated alcohols, sulfated alcohol ethoxylates, sulfated alkylphenols, alkylsulfates, sulfosuccinates, and alkylether sulfates. Exemplary anionic surfactants include, but are not limited to: sodium alkylarylsulfonate, alpha-olefinsulfonate, and fatty alcohol sulfates.

Examples of nonionic surfactants useful in the warewashing composition include, but are not limited to, those having a polyalkylene oxide polymer as a portion of the surfactant molecule. Such nonionic surfactants include, but are not limited to: chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated amines such as alkoxylated ethylene diamine; alcohol alkoxylates such as alcohol ethoxylate propoxylates, alcohol propoxylates, alcohol propoxylate ethoxylate propoxylates, alcohol ethoxylate butoxylates; nonylphenol ethoxylate, polyoxyethylene glycol ether; carboxylic acid esters such as glycerol esters, polyoxyethylene esters, ethoxylated and glycol esters of fatty acids; carboxylic amides such as diethanolamine condensates, monoalkanolamine condensates, polyoxyethylene fatty acid amides; and polyalkylene oxide block copolymers. An example of a commercially available ethylene oxide/propylene oxide block copolymer includes, but is not limited to, PLURONIC®, available from BASF Corporation, Florham Park, N.J. An example of a commercially available silicone surfactant includes, but is not limited to, ABIL® B8852, available from Goldschmidt Chemical Corporation, Hopewell, Va.

Examples of cationic surfactants that can be used in the warewashing composition include, but are not limited to: amines such as primary, secondary and tertiary monoamines with C18 alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl(C12-C18)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride. The cationic surfactant can be used to provide sanitizing properties.

Examples of zwitterionic surfactants that can be used in the warewashing composition include, but are not limited to: betaines, imidazolines, and propionates.

Because the warewashing composition is intended to be used in an automatic dishwashing or warewashing machine, the surfactants selected, if any surfactant is used, can be those that provide an acceptable level of foaming when used inside a dishwashing or warewashing machine. Warewashing compositions for use in automatic dishwashing or warewashing machines are generally considered to be low-foaming compositions. Low foaming surfactants that provide the desired level of detersive activity are advantageous in an environment such as a dishwashing machine where the presence of large amounts of foaming can be problematic. In addition to selecting low foaming surfactants, defoaming agents can also be utilized to reduce the generation of foam. Accordingly, surfactants that are considered low foaming surfactants can be used. In addition, other surfactants can be used in conjunction with a defoaming agent to control the level of foaming.

The use solution can be provided at a solids concentration that provides a desired level of detersive properties. The solids concentration refers to the concentration of the non-water components in the use solution. The warewashing composition prior to dilution can be referred to as the warewashing composition concentrate or more simply as the concentrate. The concentrate can be provided in various forms, including as a liquid and as a solid. It is expected that the warewashing composition will be used by diluting the concentrate with water at the location of use to provide the use solution. In most cases when using the warewashing composition in an automatic dishwashing or warewashing machine, it is expected that the location of use will be inside the automatic dishwashing or warewashing machine.

The solids content of the use solution is sufficient to provide the desired level of cleaning while avoiding wasting the warewashing composition by using too much. In one embodiment, the use solution has a solids content of at least about 0.05% by weight and particularly between about 0.05% by weight and about 0.75% by weight. The use solution can be prepared from the concentrate by diluting with water at a dilution ratio that provides convenient use of the concentrate and provides the formation of a use solution having desired detersive properties. In one embodiment, the concentrate is diluted at a water to concentrate ratio of at least about 20:1 and particularly between about 133:1 and about 2000:1 to provide a use solution having desired detersive properties.

Additional Functional Materials

The warewashing composition can include additional components or agents, such as additional functional materials. As such, in some embodiments, the warewashing composition including the alkaline source and corrosion inhibitor may provide a large amount, or even all of the total weight of the warewashing composition, for example, in embodiments having few or no additional functional materials disposed therein. The functional materials provide desired properties and functionalities to the warewashing composition. For the purpose of this application, the term "functional materials" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional materials may be used. For example, many of the functional materials discussed below relate to materials used in cleaning and/or destaining applications. However, other embodiments may include functional materials for use in other applications.

Builders or Water Conditioners

The warewashing composition can include one or more building agents, also called chelating or sequestering agents (e.g., builders), including, but not limited to: a condensed phosphate, a phosphonate, an aminocarboxylic acid, or a polyacrylate. In general, a chelating agent is a molecule capable of coordinating (i.e., binding) the metal ions commonly found in natural water to prevent the metal ions from interfering with the action of the other detersive ingredients of a cleaning composition. Preferable levels of addition for builders that can also be chelating or sequestering agents are between about 0.1% to about 70% by weight, about 1% to about 60% by weight, or about 1.5% to about 50% by weight. If the solid detergent is provided as a concentrate, the concentrate can include between approximately 1% to approximately 60% by weight, between approximately 3% to approximately 50% by weight, and between approximately 6% to approximately 45% by weight of the builders. Additional ranges of the builders include between approximately 3% to approximately 20% by weight, between approximately 6% to approximately 15% by weight, between approximately 25% to approximately 50% by weight, and between approximately 35% to approximately 45% by weight.

Examples of condensed phosphates include, but are not limited to: sodium and potassium orthophosphate, sodium and potassium pyrophosphate, sodium tripolyphosphate, and sodium hexametaphosphate. A condensed phosphate may also assist, to a limited extent, in solidification of the solid detergent composition by fixing the free water present in the composition as water of hydration.

Examples of phosphonates included, but are not limited to: 1-hydroxyethane-1,1-diphosphonic acid, $CH_2C(OH)[PO(OH)_2]_2$; aminotri(methylenephosphonic acid), $N[CH_2PO(OH)_2]_3$; aminotri(methylenephosphonate), sodium salt (ATMP), $N[CH_2PO(ONa)_2]_3$; 2-hydroxyethyliminobis(methylenephosphonic acid), $HOCH_2CH_2N[CH_2PO(OH)_2]_2$; diethylenetriaminepenta(methylenephosphonic acid), $(HO)_2POCH_2N[CH_2CH_2N[CH_2PO(OH)_2]_2]_2$; diethylenetriaminepenta(methylenephosphonate), sodium salt (DTPMP), $C_9H_{(28-x)}N_3Na_xO_{15}P_5$ (x=7); hexamethylenediamine(tetramethylenephosphonate), potassium salt, $C_{10}H_{(28-x)}N_2K_xO_{12}P_4$ (x=6); bis(hexamethylene)triamine(pentamethylenephosphonic acid), $(HO_2)POCH_2N[(CH_2)_2N[CH_2PO(OH)_2]_2]_2$; and phosphorus acid, $H_3PO_3$. A preferred phosphonate combination is ATMP and DTPMP. A neutralized or alkaline phosphonate, or a combination of the phosphonate with an alkali source prior to being added into the mixture such that there is little or no heat or gas generated by a neutralization reaction when the phosphonate is added is preferred.

Exemplary aminocarboxylic acids include, but are not limited to: N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), glutamic acid diacetic acid (GLDA), methylglycine diacetic acid (MGDA), and the like.

The solid detergent compositions can contain a non-phosphorus based builder. Although various components may include trace amounts of phosphorous, a composition that is considered free of phosphorous generally does not include phosphate or phosphonate builder or chelating components as an intentionally added component. Carboxylates such as citrate or gluconate are suitable. Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), and other similar acids having an amino group with a carboxylic acid substituent.

Water conditioning polymers can be used as non-phosphorus containing builders. Exemplary water conditioning polymers include, but are not limited to: polycarboxylates. Exemplary polycarboxylates that can be used as builders and/or water conditioning polymers include, but are not limited to: those having pendant carboxylate ($—CO_2^-$) groups such as polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at substoichiometric levels to function as crystal modifiers.

Bleaching Agents

Bleaching agents suitable for use in the warewashing composition for lightening or whitening a substrate include bleaching compounds capable of liberating an active halogen species, such as $Cl_2$, $Br_2$, $—OCl^-$ and/or $—OBr^-$, under conditions typically encountered during the cleansing process. Suitable bleaching agents for use in the solid detergent compositions include, but are not limited to: chlorine-containing compounds such as chlorines, hypochlorites, or chloramines. Exemplary halogen-releasing compounds include, but are not limited to: the alkali metal dichloroisocyanurates, chlorinated trisodium phosphate, the alkali metal hypochlorites, monochloramine, and dichloramine. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, potassium permonosulfate, and sodium perborate mono and tetrahydrate, with and without activators such as tetraacetylethylene diamine. When the concentrate includes a bleaching agent, it can be included in an amount of between approximately 0.1% and approximately 60% by weight, between approximately 1% and approximately 20% by weight, between approximately 3% and approximately 8% by weight, and between approximately 3% and approximately 6% by weight.

Fillers

The solid detergent composition can include an effective amount of detergent fillers which do not perform as a cleaning agent per se, but cooperates with the cleaning agent to enhance the overall cleaning capacity of the composition. Examples of detergent fillers suitable for use in the present cleaning compositions include, but are not limited to: sodium sulfate, sodium chloride, starch, and sugars. When the concentrate includes a detergent filler, it can be included in an amount up to approximately 50% by weight, between approximately 1% and approximately 30% by weight, or between approximately 1.5% and approximately 25% by weight.

Defoaming Agents

A defoaming agent for reducing the stability of foam may also be included in the warewashing composition. Examples of defoaming agents include, but are not limited to: ethylene oxide/propylene block copolymers such as those available under the name Pluronic N-3; silicone compounds such as silica dispersed in polydimethylsiloxane, polydimethylsiloxane, and functionalized polydimethylsiloxane such as those available under the name Abil B9952; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated herein by reference. When the concentrate includes a defoaming agent, the defoaming agent can be provided in an amount of between approximately 0.0001% and approximately 10% by weight, between approximately 0.001% and approximately 5% by weight, or between approximately 0.01% and approximately 1.0% by weight.

Anti-Redeposition Agents

The warewashing composition can include an anti-redeposition agent for facilitating sustained suspension of soils in a cleaning solution and preventing the removed soils from being redeposited onto the substrate being cleaned. Examples of suitable anti-redeposition agents include, but are not limited to: polyacrylates, styrene maleic anhydride copolymers, cellulosic derivatives such as hydroxyethyl cellulose, and hydroxypropyl cellulose. When the concentrate includes an anti-redeposition agent, the anti-redeposition agent can be included in an amount of between approximately 0.5% and approximately 10% by weight, and between approximately 1% and approximately 5% by weight.

Processing Aids

The components used to form the concentrate can include an aqueous medium such as water as an aid in processing. The aqueous medium helps provide the components with a desired viscosity for processing. In addition, the aqueous medium may help in the solidification process when is desired to form the concentrate as a solid.

Fragrances and Dyes

Various dyes, odorants including perfumes, and other aesthetic enhancing agents may also be included in the warewashing composition. Dyes may be included to alter the appearance of the composition, as for example, any of a variety of FD&C dyes, D&C dyes, and the like. Additional suitable dyes include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Aniline and Chemical), Metanil Yellow (Keystone Aniline and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (BASF), Pylakor Acid Bright Red (Pylam), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Methods of Manufacturing and Use

The warewashing detergent composition can be formulated to handle the expected corrosion and/or etching in a given environment by adjusting the concentration of the corrosion inhibitor. Factors affecting the concentration of the corrosion inhibitor can include, but are not limited to: water hardness, food soil concentration, alkalinity and builder concentration. It is expected that the concentration of each of the above factors can have an effect on glass corrosion and/or etching. Generally, the higher the water hardness, the food soil concentration, the alkalinity of the use solution and the builder concentration in the use solution, the greater the concentration of corrosion inhibitor needed to prevent corrosion or etching. For example, in machine warewashing applications, a water hardness of about 15 grains per gallon (GPG) or more is considered high, a water hardness of about 6 GPG to about 14 GPG is considered medium and a water hardness of about 5 GPG or less is considered low. With regard to food soils, a food soil concentration of about 25 grams per gallon or more is considered high, a concentration of about 15 to about 24 grams per gallon is considered medium and a concentration of about 14 grams per gallon or less is considered low. In a use solution, an alkalinity of about 300 ppm or higher is considered high, an alkalinity of about 200 ppm to about 300 ppm is considered medium, and an alkalinity of about 200 ppm or less is considered low. In a use solution, a builder concentration of about 300 ppm or more is considered high, a builder concentration of about 150 ppm to about 300 ppm is considered medium, and a builder concentration of 150 ppm or less is considered low.

Based upon the expected conditions of use, the warewashing detergent composition can be formulated to provide the desired level of corrosion and/or etching resistance. Based upon the knowledge of water hardness, food soil concentration, alkalinity, and builder concentration expected at the situs of use, the warewashing detergent composition can be formulated with a sufficient amount of corrosion inhibitor by reference to FIG. 1. In FIG. 1, the charted values represent the use solution concentration of corrosion inhibitor that is sufficient to reduce corrosion or etching of the substrate being cleaned.

As previously mentioned, the warewashing composition can be provided in the form of a solid. Exemplary solid warewashing compositions are disclosed in U.S. Pat. Nos. 6,410,495 to Lentsch et al., 6,369,021 to Man et al., 6,258,765 to Wei et al, 6,177,392 to Lentsch et al., 6,164,296 to Lentsch et al., 6,156,715 to Lentsch et al., and 6,150,624 to Lentsch et al. The compositions of each of these patents are incorporated herein by reference. The compositions of each of these patents can be modified to provide a warewashing composition that includes an effective amount of soluble lithium salt, soluble aluminum salt and/or soluble silicate salt to provide a warewashing use solution resulting in reduced glass corrosion.

Solid compositions of the present invention can be produced using a batch or continuous mixing system. In an exemplary embodiment, a single- or twin-screw extruder is used to combine and mix one or more cleaning agents at high shear to form a homogeneous mixture. In some embodiments, the processing temperature is at or below the melting temperature of the components. The processed mixture may be dispensed from the mixer by forming, casting or other suitable means, whereupon the detergent composition hardens to a solid form. The structure of the matrix may be characterized according to its hardness, melting point, material distribution, crystal structure, and other like properties according to known methods in the art. Generally, a solid composition processed according to the method of the invention is substantially homogeneous with regard to the distribution of ingredients throughout its mass and is dimensionally stable.

Specifically, in a forming process, the liquid and solid components are introduced into the final mixing system and are continuously mixed until the components form a substantially homogeneous semi-solid mixture in which the components are distributed throughout its mass. In an exemplary embodiment, the components are mixed in the mixing system for at least approximately 5 seconds. The mixture is then discharged from the mixing system into, or through, a die or other shaping means. The product is then packaged. In an exemplary embodiment, the formed composition begins to harden to a solid form in between approximately 1 minute and approximately 3 hours. Particularly, the formed composition begins to harden to a solid form in between approximately 1 minute and approximately 2 hours. More particularly, the formed composition begins to harden to a solid form in between approximately 1 minute and approximately 20 minutes.

Specifically, in a casting process, the liquid and solid components are introduced into the final mixing system and are continuously mixed until the components form a substantially homogeneous liquid mixture in which the components are distributed throughout its mass. In an exemplary embodiment, the components are mixed in the mixing system for at least approximately 60 seconds. Once the mixing is complete, the product is transferred to a packaging container where solidification takes place. In an exemplary embodiment, the cast composition begins to harden to a solid form in between approximately 1 minute and approximately 3 hours. Particularly, the cast composition begins to harden to a solid form in between approximately 1 minute and approximately 2 hours. More particularly, the cast composition begins to harden to a solid form in between approximately 1 minute and approximately 20 minutes.

By the term "solid form", it is meant that the hardened composition will not flow and will substantially retain its shape under moderate stress or pressure or mere gravity. The degree of hardness of the solid cast composition may range from that of a fused solid product which is relatively dense and hard, for example, like concrete, to a consistency characterized as being a hardened paste. In addition, the term "solid" refers to the state of the detergent composition under the expected conditions of storage and use of the solid detergent composition. In general, it is expected that the detergent composition will remain in solid form when exposed to temperatures of up to approximately 100° F. and particularly greater than approximately 120° F.

The resulting solid detergent composition may take forms including, but not limited to: a cast solid product; an extruded, molded or formed solid pellet, block, tablet, powder, granule, flake; or the formed solid can thereafter be ground or formed into a powder, granule, or flake. In an exemplary embodiment, extruded pellet materials formed by the solidification matrix have a weight of between approximately 50 grams and approximately 250 grams, extruded solids formed by the solidification matrix have a weight of approximately 100 grams or greater, and solid block detergents formed by the solidification matrix have a mass of between approximately 1 and approximately 10 kilograms. The solid compositions provide for a stabilized source of functional materials. In some embodiments, the solid composition may be dissolved, for example, in an aqueous or other medium, to create a concentrated and/or use solution. The solution may be directed to a storage reservoir for later use and/or dilution, or may be applied directly to a point of use.

In certain embodiments, the solid composition is provided in the form of a unit dose. A unit dose refers to a solid composition unit sized so that the entire unit is used during a single washing cycle. When the solid composition is provided as a unit dose, it is typically provided as a cast solid, an extruded pellet, or a tablet having a size of between approximately 1 gram and approximately 50 grams.

In other embodiments, the solid composition is provided in the form of a multiple-use solid, such as a block or a plurality of pellets, and can be repeatedly used to generate aqueous detergent compositions for multiple washing cycles. In certain embodiments, the solid composition is provided as a cast solid, an extruded block, or a tablet having a mass of between approximately 5 grams and approximately 10 kilograms. In certain embodiments, a multiple-use form of the solid detergent composition has a mass between approximately 1 kilogram and approximately 10 kilograms. In further embodiments, a multiple-use form of the solid detergent composition has a mass of between approximately 5 kilograms and about approximately 8 kilograms. In other embodiments, a multiple-use form of the solid detergent composition has a mass of between about approximately 5 grams and approximately 1 kilogram, or between approximately 5 grams and approximately 500 grams.

When the components that are processed to form the concentrate are processed into a block, it is expected that the components can be processed by extrusion techniques or casting techniques. In general, when the components are processed by extrusion techniques, it is believed that the composition can include a relatively smaller amount of water as an aid for processing compared with the casting techniques. In general, when preparing the solid by extrusion, the composition can contain between about 2% by weight and about 10% by weight water. When preparing the solid by casting, it is expected that the amount of water can be provided in an amount of between about 1% by weight and about 50% by weight, and between about 2% by weight and about 40% by weight.

Although the warewashing composition is discussed as being formed into a solid product, the warewashing composition may also be provided in the form of a paste. When the concentrate is provided in the form of a paste, enough water is added to the warewashing composition such that complete solidification of the warewashing composition is precluded. In addition, dispersants and other components may be incorporated into the warewashing composition in order to maintain a desired distribution of components.

The packaging receptacle or container may be rigid or flexible, and composed of any material suitable for containing the compositions produced according to the invention, as for example glass, metal, plastic film or sheet, cardboard, cardboard composites, paper, and the like. Advantageously, since the composition is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions. Preferred packaging used to contain the compositions is manufactured from a flexible, easy opening film material.

The warewashing composition made according to the present invention is dispensed from a spray-type dispenser such as that disclosed in U.S. Pat. Nos. 4,826,661, 4,690,305, 4,687,121, 4,426,362 and in U.S. Pat. Nos. Re 32,763 and 32,818, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use. When used, the product can be removed from the package (e.g. film) and is inserted into the dispenser. The spray of water can be made by a nozzle in a shape that conforms to the solid detergent shape. The dispenser enclosure can also closely fit the detergent shape in a dispensing system that prevents the introduction and dispensing of an incorrect detergent.

While the invention is described in the context of a warewashing composition for washing articles in an automatic dishwashing machine, it should be understood that the warewashing composition can be used for washing non-ware items. That is, the warewashing composition can be referred to as a cleaning composition and can be used to clean various items and, in particular, items that may suffer from corrosion and/or etching. Because the warewashing composition can be used in an automatic dishwashing machine, there are certain components that can be excluded from the warewashing composition because their presence would be detrimental in an automatic dishwashing machine.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Materials Used

Solid Power: a cast warewashing detergent composition including NaOH and $Na_2CO_3$, available from Ecolab Inc., St. Paul, Minn.

Solid Power with Etch Protection: a cast warewashing detergent composition including NaOH and $Na_2CO_3$ and a calcium aluminate etch protectant available from Ecolab Inc., St. Paul, Minn.

Kiseki No Phosphate (KNP): an extruded warewashing detergent composition including $Na_2CO_3$ and $NaHCO_3$ and a corrosion inhibitor, available from Ecolab Inc., St. Paul, Minn.

Kiseki No Phosphate (KNP) with Etch Protection: an extruded warewashing detergent composition including $Na_2CO_3$ and $NaHCO_3$, a corrosion inhibitor and a calcium aluminate etch protectant available from Ecolab Inc., St. Paul, Minn.

Liquid Premix: a composition of chelants and 6.746 sodium aluminuate (45%) available from Ecolab Inc., St. Paul, Minn.

LithSil 25 a lithium silicate composition available from PQ Corporation, Valley Forge, Pa., containing 23% solids in water, from which 2.5% is $Li_2O$ and 20.5% is $Si_2O$.

Glass Etch/Corrosion Test

The following examples were conducted to compare the level of etching of Libbey® glasses washed with several different warewashing compositions. The glassware obtained was unused and fresh out of the box. After cleaning the glasses, one glass was placed in a quartz plastic container. About 20 mL of one of the warewashing compositions was poured into the plastic container such that the glass was completely covered. A lid was put on the container and labeled with the name of the warewashing composition. There were two samples tested for each warewashing composition. The plastic containers were then placed in an agitated soft water bath having a controlled temperature of about 160° F. About 20 mL samples of each of the warewashing composition was collected every 24 hours and placed in 1 oz. plastic bottles and labeled. A water dispensing mechanism was set up to replenish the water bath throughout the duration of the test. Upon completion of the test, the samples were analyzed for calcium and silicon content.

To measure the amount of glass corrosion and/or etching and to demonstrate the protective effect of each of the corrosion inhibitors in the warewashing compositions, the rates at which components were removed from the glassware after being exposed to the warewashing compositions were measured. Over a period of days, the change in concentration of elemental silicon and elemental calcium in the warewashing composition samples were analytically measured. Common soda-lime glass includes oxides of silicon, sodium, calcium, magnesium, and aluminum. Because it is well known that detergent builders can form complexes with calcium, the presence of calcium in the warewashing composition samples was measured to determine whether the detergent builders were accelerating the removal of calcium from the glass surface and thereby contributing to the corrosion process. Because polyethelyne bottles were used to contain the warewashing composition samples, the only source of the elements of interest was the glass specimens.

Examples 1, 2 and 3 and Comparative Example A

Three cast warewashing compositions were initially tested including varying concentrations of the corrosion inhibitor of the present invention according to the method described above to determine their ability to reduce etching of glassware. The composition of Example 1 included Solid Power with no Etch Protection and 5 ppm LithSil, the composition of Example 2 included Solid Power with no Etch Protection and 25 ppm LithSil and the composition of Example 3 included Solid Power with no Etch Protection and 50 ppm LithSil. LithSil contains 23% solids in water, from which 2.5% is $Li_2O$ and 20.5% is $Si_2O$. Thus, 5 ppm LithSil represents 0.125 ppm $Li_2O$ and 1.025 ppm $Si_2O$, 25 ppm LithSil represents 0.625 ppm $Li_2O$ and 5.125 ppm $Si_2O$, 50 ppm LithSil represents 1.25 ppm $Li_2O$ and 10.25 ppm $Si_2O$.

The composition of Comparative Example A included Solid Power with no Etch Protection.

Table 1 lists the warewashing composition, the number of hours the glassware was exposed to each of the warewashing compositions at 160° F., the average parts per million (ppm) of calcium and silicon detected, the total amount of calcium and silicon and the total amount of silicon.

TABLE 1

| | Warewashing Composition | Time at 160° F. | Average Calcium (ppm) | Average Silicon (ppm) | Silicon Calcium Total | Silicon Total ($T - T_0$) |
|---|---|---|---|---|---|---|
| Example 1 | Solid Power no | 0 | 0.00 | 8.60 | 8.60 | 0.00 |
| | Etch Protection + | 24 | 2.18 | 18.75 | 12.34 | 10.16 |
| | 5 ppm LithSil | 48 | 6.56 | 37.10 | 35.06 | 28.51 |
| | | 120 | 12.65 | 67.40 | 71.46 | 58.81 |
| Example 2 | Solid Power no | 0 | 0.00 | 9.46 | 9.46 | 0.00 |
| | Etch Protection + | 24 | 2.45 | 21.45 | 14.44 | 12.00 |
| | 25 ppm LithSil | 48 | 6.12 | 37.80 | 34.46 | 28.35 |
| | | 120 | 12.50 | 60.95 | 64.00 | 51.50 |
| Example 3 | Solid Power no | 0 | 0.00 | 10.55 | 10.55 | 0.00 |
| | Etch Protection + | 24 | 2.50 | 22.85 | 14.80 | 12.30 |
| | 50 ppm LithSil | 48 | 6.09 | 39.05 | 34.59 | 28.50 |
| | | 120 | 12.40 | 67.50 | 69.35 | 56.95 |

TABLE 1-continued

| | Warewashing Composition | Time at 160° F. | Average Calcium (ppm) | Average Silicon (ppm) | Silicon Calcium Total | Silicon Total ($T - T_0$) |
|---|---|---|---|---|---|---|
| Comparative Example A | Solid Power no Etch Protection | 0 | 0.00 | 8.20 | 8.20 | 0.00 |
| | | 24 | 4.87 | 30.10 | 26.78 | 21.91 |
| | | 48 | 9.93 | 53.25 | 54.99 | 45.06 |
| | | 120 | 18.50 | 91.60 | 101.91 | 83.41 |

As can be seen by the results in Table 1, glassware exposed to the compositions of Examples 1, 2 and 3 including varying concentrations of LithSil had reduced amounts of etching compared to glassware exposed to a commercially available product, Comparative Example A. In particular, after 24 hours, the amounts of etching on glassware that were washed with the compositions of Examples 1, 2 and 3 were reduced by about 53.64%, 45.24% and 43.85%, respectively, when compared to the amount of etching on glassware that was washed with the composition of Comparative Example A.

After about 48 hours, the amounts of etching of the glassware washed with the compositions of Examples 1, 2 and 3 were reduced by about 36.73%, 37.09% and 36.74%, respectively, when compared to the amount of etching resulting from washing with the composition of Comparative Example A. After about 120 hours, the amounts of etching of the glassware washed with the compositions of Examples 1, 2 and 3 were reduced by about 29.49%, 38.26% and about 31.72%, respectively, when compared to the amount of etching resulting from washing with the composition of Comparative Example A.

Examples 4, 5, 6, 7 and 8 and Comparative Example B

A plurality of other warewashing compositions including varying concentrations of the corrosion inhibitor of the present invention were tested according to the method described above to determine their ability to reduce etching of glassware. The composition of Example 4 included Solid Power with and 28 ppm LithSil, the composition of Example 5 included Solid Power with Etch Protection and 22.5 ppm LithSil, the composition of Example 6 included Solid Power with Etch Protection and 16.9 ppm LithSil, the composition of Example 7 included Solid Power with Etch Protection and 11.25 ppm LithSil and the composition of Example 8 included Solid Power with Etch Protection and 10 ppm LithSil.

The composition of Comparative Example B included Solid Power with Etch Protection but did not include LithSil.

Table 2 lists the warewashing composition, the number of hours the glassware was exposed to each of the warewashing compositions at 160° F., the average parts per million (ppm) of calcium and silicon detected, the total amount of calcium and silicon and the total amount of silicon.

TABLE 2

| | Warewashing Composition | Time at 160° F. | Average Calcium (ppm) | Average Silicon (ppm) | Silicon Calcium Total | Silicon Total ($T - T_0$) |
|---|---|---|---|---|---|---|
| Example 4 | Solid Power with | 0 | 0.50 | 21.20 | 21.70 | 0.00 |
| | Etch Protection + | 24 | 3.22 | 35.90 | 17.42 | 14.70 |
| | 28 ppm LithSil | 48 | 4.97 | 44.60 | 27.87 | 23.40 |
| Example 5 | Solid Power with | 0 | 0.50 | 18.70 | 19.20 | 0.00 |
| | Etch Protection + | 24 | 2.94 | 31.55 | 15.29 | 12.85 |
| | 22.5 ppm LithSil | 48 | 4.99 | 43.00 | 28.79 | 24.30 |
| Example 6 | Solid Power with | 0 | 0.50 | 16.35 | 16.85 | 0.00 |
| | Etch Protection, | 24 | 2.35 | 25.75 | 11.25 | 9.40 |
| | 16.9 ppm LithSil | 48 | 4.60 | 35.40 | 23.15 | 19.05 |
| Example 7 | Solid Power with | 0 | 0.50 | 14.20 | 14.70 | 0.00 |
| | Etch Protection + | 24 | 2.13 | 23.10 | 10.53 | 8.90 |
| | 11.25 ppm LithSil | 48 | — | — | — | — |
| Example 8 | Solid Power with | 0 | — | — | — | — |
| | Etch Protection + | 24 | — | — | — | — |
| | 10 ppm LithSil | 48 | 4.25 | 32.90 | 22.45 | 18.70 |
| Comp. Example B | Solid Power with | 0 | 0.50 | 10.03 | 10.53 | 0.00 |
| | Etch Protection | 24 | 3.88 | 29.70 | 23.05 | 19.68 |
| | | 48 | 6.37 | 43.90 | 39.74 | 33.88 |

As can be seen by the results in Table 2, glassware exposed to the composition of Examples 4, 5, 6, 7 and 8 including varying concentrations of LithSil had reduced amounts of etching compared to glassware exposed to a commercially available product, Comparative Example B. In particular, after 24 hours, the amounts of etching on glassware that were washed with the compositions of Examples 4, 5, 6 and 7 were reduced by about 24.43%, 33.69%, 51.21% and 54.32%, respectively, when compared to the amount of etching on glassware that was washed with the composition of Comparative Example B.

After about 48 hours, the amounts of etching of the glassware washed with the compositions of Examples 4, 5, 6 and 8 were reduced by about 29.88%, 27.57%, 41.76 and 43.52%, respectively, when compared to the amount of etching resulting from washing with the composition of Comparative Example B. It was also observed that as the concentration of $Li_2SiO_3$ decreased, the percent etch reduction generally increased.

Example 11 and Comparative Example C

A test was then performed to determine the effect of LiOH on etch reduction when used in conjunction with Solid Power with Etch Protection. The composition of Example 11 of the present invention included Solid Power with Etch Protection and 4.4 ppm of LiOH (2.745 ppm $Li_2O$).

A second composition was used for comparison and included Solid Power with Etch Protection (Comparative Example C).

Table 3 lists the warewashing composition, the number of hours the glassware was exposed to the warewashing composition at 160° F., the average parts per million (ppm) of calcium and silicon detected, the total amount of calcium and silicon and the total amount of silicon.

TABLE 3

| | Warewashing Composition | Time at 160° F. (hours) | Average Calcium (ppm) | Average Silicon (ppm) | Silicon Calcium Total | Silicon Total ($T - T_0$) |
|---|---|---|---|---|---|---|
| Example 11 | Solid Power with | 0 | 1.49 | 9.45 | 10.94 | 0.00 |
| | Etch protection + | 24 | 3.02 | 16.50 | 8.58 | 7.06 |
| | 4.4 ppm LiOH | 48 | 5.13 | 25.55 | 19.75 | 16.11 |
| | | 120 | 7.58 | 37.90 | 34.54 | 28.46 |
| Comparative | Solid Power with | 0 | 1.55 | 8.15 | 9.70 | 0.00 |
| Example C | Etch protection | 24 | 3.05 | 16.55 | 9.91 | 8.40 |
| | | 48 | 5.13 | 26.30 | 21.74 | 18.15 |
| | | 120 | 7.49 | 37.90 | 35.70 | 29.75 |

As can be seen by the results in Table 3, glassware exposed to the composition of Example 11 including LiOH had a reduced amount of etching compared to glassware exposed to a commercially available product, Comparative Example C. In particular, after 24 hours, the amount of etching on glassware washed with the composition of Example 11 was reduced by about 13.42% when compared to the amount of etching resulting from washing with the composition of Comparative Example C. After about 48 hours, the amount of etching of the glassware washed with the composition of Example 11 was reduced by about 9.15%, when compared to the amount of etching resulting from washing with the composition of Comparative Example C. After about 120 hours, the amount of etching of the glassware washed with the composition of Example 11 was reduced by about 3.25% when compared to the amount of etching resulting from washing with the composition of Comparative Example C.

The results shows that the LiOH gives higher, or substantially the same level of protection as a commercially available etch protection system.

Example 12 and Comparative Example D

After observing the results of using LiOH with Solid Power with Etch Protection, a test was then performed to determine the effect of LiOH on etch reduction when used in conjunction with Solid Power with no Etch Protection. The composition of Example 12 included Solid Power with no Etch Protection and 4.4 ppm of LiOH (2.745 ppm $Li_2O$).

A second composition was used for comparison and included Solid Power with no Etch Protection (Comparative Example D).

Table 4 lists the warewashing composition, the number of hours the glassware was exposed to the warewashing composition at 160° F., the average parts per million (ppm) of calcium and silicon detected, the total amount of calcium and silicon and the total amount of silicon.

TABLE 4

| | Warewashing Composition | Time at 160° F. (hours) | Average Calcium (ppm) | Average Silicon (ppm) | Silicon Calcium Total | Silicon Total ($T - T_0$) |
|---|---|---|---|---|---|---|
| Example 12 | Solid Power no | 0 | 2.51 | 8.34 | 10.85 | 0.00 |
| | Etch protection + | 24 | 6.57 | 25.70 | 21.43 | 17.36 |
| | 4.4 ppm LiOH | 48 | 9.17 | 38.60 | 36.93 | 30.26 |
| | | 96 | 12.30 | 53.80 | 55.26 | 45.46 |
| Comparative | Solid Power no | 0 | 3.77 | 8.55 | 12.32 | 0.00 |
| Example D | Etch protection | 24 | 7.71 | 21.15 | 20.55 | 16.61 |
| | | 48 | 10.20 | 36.45 | 34.34 | 27.91 |
| | | 96 | 13.05 | 50.70 | 51.44 | 42.16 |

As can be seen by the results in Table 4, glassware exposed to the composition of Example 12 including LiOH had a substantially similarly amount of etch reduction compared to glassware exposed to a commercially available product, Comparative Example D. The results showed that using LiOH by itself did not result in increased etch reduction and that the lithium in combination with aluminate or silicate showed improved etch reduction.

Examples 13 and 14 and Comparative Example E

Two additional compositions of the present invention were then tested to determine the effect of aluminate and silicate in combination with lithium on reducing etch. The first composition, Example 13, included Solid Power with no Etch Protection and 4.4 ppm of LiOH. The second composition, Example 14, included Solid Power with no Etch Protection, 4.4 ppm of LiOH (2.745 ppm $Li_2O$) and 0.95 ppm of $NaAlO_2$.

A third composition was used for comparison and included Solid Power with no Etch Protection (Comparative Example E).

Table 5 lists the warewashing composition, the number of hours the glassware was exposed to the warewashing composition at 160° F., the average parts per million (ppm) of calcium and silicon detected, the total amount of calcium and silicon and the total amount of silicon.

TABLE 5

| | Warewashing Composition | Time at 160° F. (hours) | Average Calcium (ppm) | Average Silicon (ppm) | Silicon Calcium Total | Silicon Total ($T - T_0$) |
|---|---|---|---|---|---|---|
| Example 13 | Solid Power no | 0 | 0.91 | 10.00 | 10.91 | 0.00 |
| | Etch protection + | 24 | 4.615 | 27.35 | 21.06 | 17.35 |
| | 4.4 ppm LiOH | 48 | 7.56 | 40.80 | 37.45 | 30.80 |
| | | 96 | 10.60 | 56.25 | 55.95 | 46.25 |
| Example 14 | Solid Power no | 0 | 6.09 | 10.15 | 16.24 | 0.00 |
| | Etch protection + | 24 | 6.74 | 13.60 | 4.11 | 3.45 |
| | 4.4 ppm LiOH + | 48 | 8.03 | 19.75 | 11.55 | 9.60 |
| | 0.95 ppm $NaAlO_2$ | 96 | 10.25 | 29.75 | 23.77 | 19.60 |
| Comp. | Solid Power no | 0 | 1.05 | 10.05 | 11.10 | 0.00 |
| Example E | Etch protection | 24 | 5.08 | 28.80 | 22.78 | 18.75 |
| | | 48 | 8.06 | 43.00 | 39.96 | 32.95 |
| | | 96 | 10.95 | 56.85 | 56.70 | 46.80 |

As can be seen by the results in Table 5, glassware exposed to the composition of Example 13 including only LiOH had a slightly reduced amount of etching compared to glassware exposed to a commercially available product, Comparative Example E. The amount of etching was further reduced when LiOH and $NaAlO_2$ were both added to Solid Power (Example 14). In particular, after 24 hours, the amount of etching on glassware washed with the composition of Example 13 was reduced by about 7.55% when compared to the amount of etching resulting from washing with the composition of Comparative Example E. After 24 hours, the amount of etching on glassware washed with the composition of Example 14 was reduced by over 81% when compared to the amount of etching resulting from washing with the composition of Comparative Example E.

After about 48 hours, the amounts of etching of the glassware washed with the compositions of Examples 13 and 14 were reduced by about 6.28% and 71.11%, respectively, when compared to the amount of etching resulting from washing with the composition of Comparative Example E. After about 96 hours, the amounts of etching of the glassware washed with the compositions of Examples 13 and 14 were reduced by about 1.33% and about 58.09%, respectively, when compared to the amount of etching resulting from washing with the composition of Comparative Example E.

The results indicate that LiOH in combination with sodium aluminate provides over 50% reduction in glass etching in caustic-based cast products.

Examples 15 and 16 and Comparative Example F

A plurality of other warewashing compositions that included the corrosion inhibitor of the present invention in combination with a commercially available detergent were tested according to the method described above to determine their ability to reduce etching of glassware. In particular, the effect of using sodium aluminate 45% in combination with 25 ppm LithSil was tested. The composition of Example 15 included Solid Power with no Etch Protection and 4.4 ppm LiOH (2.745 ppm $Li_2O$). The composition of Example 16 included Solid Power with no Etch Protection, 25 ppm LithSil (0.625 ppm $Li_2O$ and 5.125 ppm $SiO_2$) and 2.11 ppm sodium aluminate 45% (0.25 ppm active sodium aluminate).

The composition of Comparative Example F included Solid Power with no Etch Protection.

Table 6 lists the warewashing composition, the number of hours the glassware was exposed to the warewashing composition at 160° F., the average parts per million (ppm) of calcium and silicon detected, the total amount of calcium and silicon and the total amount of silicon.

TABLE 6

| | Warewashing Composition | Time at 160° F. | Average Calcium (ppm) | Average Silicon (ppm) | Silicon Calcium Total | Silicon Total ($T - T_0$) |
|---|---|---|---|---|---|---|
| Example 15 | Solid Power no | 0 | 0.50 | 25.10 | 25.60 | 0.00 |
| | Etch Protection + | 24 | 4.34 | 43.55 | 22.29 | 18.45 |
| | 25 ppm LithSil | 48 | 7.48 | 58.60 | 40.48 | 33.50 |
| | | 96 | 10.65 | 74.15 | 59.20 | 49.05 |
| Example 16 | Solid Power no | 0 | 0.50 | 26.10 | 26.60 | 0.00 |
| | Etch Protection + | 24 | 0.78 | 29.65 | 3.83 | 3.55 |
| | 25 ppm LithSil + | 48 | 2.12 | 35.90 | 11.42 | 9.80 |
| | 2.11 ppm $NaAlO_2$ | 96 | 3.82 | 43.15 | 20.37 | 17.05 |
| Comparative | Solid Power no | 0 | .050 | 10.85 | 11.35 | 0.00 |
| Example F | Etch Protection | 24 | 4.00 | 28.50 | 21.15 | 17.65 |
| | | 48 | 7.47 | 45.25 | 41.37 | 34.40 |
| | | 12096 | 10.25 | 57.35 | 56.25 | 46.50 |

As shown in Table 6, glassware exposed to the composition of Example 15 including a soluble lithium salt had substantially similar reduced etching compared to glassware exposed to a commercially available product, Comparative Example F. By contrast, glassware exposed to the composition of Example 16 including a soluble lithium salt and a soluble aluminum salt had substantially reduced etching compared to glassware exposed to a commercially available product, Comparative Example F. In particular, after 24 hours, the amount of etching on glassware washed with the composition of Example 15 was substantially similar to the amount of etching resulting from washing with the composition of Comparative Example F. After 24 hours, the amount of etching on glassware washed with the composition of Example 16 was reduced by about 81.89% when compared to the amount of etching resulting from washing with the composition of Comparative Example F.

After about 48 hours, the amounts of etching of the glassware washed with the compositions of Examples 15 and 16 were reduced by about 2.15% and about 72.40%, respectively, when compared to the amount of etching resulting from washing with the composition of Comparative Example F. After about 96 hours, the amount of etching of the glassware washed with the composition of Example 15 was substantially the same as the amount of etching of the glassware washed with the composition of Comparative Example F while the amount of etching of the glassware washed with the composition of the composition of Example 16 was reduced by about 63.79% when compared to the amount of etching resulting from washing with the composition of Comparative Example F.

Examples 17, 18 and 19 and Comparative Example G

A plurality of extruded warewashing compositions including varying concentrations of the corrosion inhibitor of the present invention were tested according to the method described above to determine their ability to reduce etching of glassware. In particular, three compositions of the present invention were tested. The composition of Example 17 included Kiseki No Phosphate (KNP) with no Etch Protection and 5 ppm LithSil (lithium silicate), the composition of Example 18 included KNP with no Etch Protection and 25 ppm LithSil and the composition of Example 19 included KNP with no Etch Protection and 50 ppm LithSil. 5 ppm LithSil contains 23% solids in water from which 2.5% is $Li_2O$ and 20.5% is $Si_2O$. Thus, 5 ppm LithSil represents 0.125 ppm $Li_2O$ and 1.025 ppm $Si_2O$, 25 ppm LithSil represents 0.625 ppm $Li_2O$ and 5.125 ppm $Si_2O$, 50 ppm LithSil represents 1.25 ppm $Li_2O$ and 10.25 ppm $Si_2O$.

The composition of Comparative Example G included Kiseki No Phosphate with no Etch Protection.

Table 7 lists the warewashing composition, the number of hours the glassware was exposed to each of the warewashing compositions at 160° F., the average parts per million (ppm) of calcium and silicon detected, the total amount of calcium and silicon and the total amount of silicon.

TABLE 7

| | Warewashing Composition | Time at 160° F. | Average Calcium (ppm) | Average Silicon (ppm) | Silicon Calcium Total | Silicon Total ($T - T_0$) |
|---|---|---|---|---|---|---|
| Example 17 | KNP no Etch | 0 | 0.00 | 8.42 | 8.42 | 0.00 |
| | Protection + | 24 | 3.99 | 25.85 | 21.42 | 17.43 |
| | 5 ppm LithSil | 48 | 8.04 | 43.15 | 42.77 | 34.73 |
| | | 120 | 18.90 | 86.65 | 97.14 | 78.23 |
| Example 18 | KNP no Etch | 0 | 0.00 | 9.33 | 9.33 | 0.00 |
| | Protection + | 24 | 3.85 | 26.55 | 21.08 | 17.22 |
| | 25 ppm LithSil | 48 | 7.82 | 45.10 | 43.61 | 35.77 |
| | | 120 | 18.90 | 88.55 | 98.13 | 79.22 |
| Example 19 | KNP no Etch | 0 | 0.00 | 10.15 | 10.15 | 0.00 |
| | Protection + | 24 | 3.9. | 27.50 | 21.28 | 17.35 |
| | 50 ppm LithSil | 48 | 7.92 | 47.65 | 45.42 | 37.5 |
| | | 120 | 18.95 | 89.00 | 97.80 | 78.85 |
| Comparative | KNP no Etch | 0 | 0.00 | 8.08 | 8.08 | 0.00 |
| Example G | Protection | 24 | 3.92 | 25.50 | 21.35 | 17.42 |
| | | 48 | 7.97 | 45.45 | 45.34 | 37.45 |
| | | 120 | 18.30 | 86.15 | 96.38 | 78.07 |

As can be seen by the results in Table 7, glassware exposed to the composition of Examples 17, 18 and 19 including varying concentrations of LithSil had marginal improvement, if any, compared to glassware exposed to a commercially available product, Comparative Example G.

Examples 20 and 21 and Comparative Example H

Two compositions of the present invention were then tested to determine wither Kiseki No Phosphate (KNP) used in combination with LiOH and a Kiseki Liquid Premix would provide etch protection. The first composition, Example 20, included KNP with Etch Protection, Liquid Premix and 4.4 ppm of LiOH. The second composition, Example 21, included KNP with Etch Protection, Liquid Premix, 4.4 ppm of LiOH (2.745 ppm $Li_2O$) and 0.95 ppm of $NaAlO_2$. The Liquid Premix included a combination of chelants and 6.746 sodium aluminate 45%.

A third composition was used for comparison and included KNP with Etch Protection (Comparative Example H).

Table 8 lists the warewashing composition, the number of hours the glassware was exposed to the warewashing composition at 160° F., the average parts per million (ppm) of calcium and silicon detected, the total amount of calcium and silicon and the total amount of silicon.

TABLE 8

| | Warewashing Composition | Time at 160° F. (hours) | Average Calcium (ppm) | Average Silicon (ppm) | Silicon Calcium Total | Silicon Total ($T - T_0$) |
|---|---|---|---|---|---|---|
| Example 20 | KNP with Etch | 0 | 10.95 | 8.45 | 19.40 | 0.00 |
| | Protection + | 24 | 12.00 | 11.80 | 4.40 | 3.35 |
| | 4.4 ppm LiOH | 48 | 13.05 | 17.30 | 10.95 | 8.85 |
| | with Liquid Premix | 96 | 16.30 | 31.75 | 28.65 | 23.30 |
| Example 21 | KNP with Etch | 0 | 11.25 | 8.45 | 19.70 | 0.00 |
| | Protection + | 24 | 12.50 | 11.75 | 4.55 | 3.30 |
| | 6 ppm LiOH | 48 | 13.45 | 16.85 | 10.60 | 8.40 |
| | with Liquid Premix | 96 | 16.60 | 31.55 | 28.45 | 23.10 |
| Comparative | KNP with Etch | 0 | 2.93 | 8.06 | 10.99 | 0.00 |
| Example H | Protection | 24 | 8.00 | 29.15 | 26.16 | 21.09 |
| | | 48 | 10.83 | 42.15 | 41.99 | 34.09 |
| | | 96 | 15.15 | 61.95 | 66.11 | 53.89 |

As can be seen by the results in Table 8, glassware exposed to the composition of Examples 20 and 21 including LiOH had a reduced amount of etching compared to glassware exposed to a commercially available product, Comparative Example H. In particular, after 24 hours, the amount of etching on glassware washed with the composition of Example 20 was reduced by about 83.18% when compared to the amount of etching resulting from washing with the composition of Comparative Example H. After 24 hours, the amount of etching on glassware washed with the composition of Example 21 was reduced by 82.61% when compared to the amount of etching resulting from washing with the composition of Comparative Example H.

After about 48 hours, the amounts of etching of the glassware washed with the compositions of Examples 20 and 21 were reduced by about 73.92% and 74.76%, respectively, when compared to the amount of etching resulting from washing with the composition of Comparative Example H. After about 96 hours, the amounts of etching of the glassware washed with the compositions of Examples 20 and 21 were reduced by about 56.67% and about 56.97%, respectively, when compared to the amount of etching resulting from washing with the composition of Comparative Example H.

The results indicate that the LiOH provided good protection because the aluminate present in the Liquid Premix activated the lithium.

Examples 22 and 23 and Comparative Example I

A test was then performed to determine the effect of LiOH on etch reduction when used in conjunction with Kiseki No Phosphate (KNP) with Etch Protection. The composition of Example 22 included Kiseki No Phosphate (KNP) with Etch Protection and 4.4 ppm LiOH (2.745 ppm $Li_2O$). The composition of Example 23 included KNP with Etch Protection, 25 ppm LithSil (0.625 ppm $Li_2O$ and 5.125 ppm $SiO_2$) and 2.11 ppm sodium aluminate 45% (0.25 ppm active sodium aluminate).

The composition of Comparative Example I included KNP with Etch Protection.

Table 9 lists the warewashing composition, the number of hours the glassware was exposed to the warewashing composition at 160° F., the average parts per million (ppm) of calcium and silicon detected, the total amount of calcium and silicon and the total amount of silicon.

TABLE 9

| | Warewashing Composition | Time at 160° F. | Average Calcium (ppm) | Average Silicon (ppm) | Silicon Calcium Total | Silicon Total ($T - T_0$) |
|---|---|---|---|---|---|---|
| Example 22 | KNP with Etch | 0 | 0.61 | 8.11 | 8.72 | 0.00 |
| | Protection + | 24 | 1.84 | 13.90 | 7.02 | 5.79 |
| | 4.4 ppm LiOH | 48 | 4.97 | 28.70 | 24.95 | 20.59 |
| | | 120 | 9.40 | 46.85 | 47.53 | 38.74 |
| Example 23 | KNP with Etch | 0 | 0.77 | 18.20 | 18.97 | 0.00 |
| | Protection + | 24 | 2.05 | 25.85 | 8.92 | 7.65 |
| | 25 ppm LithSil and | 48 | 5.15 | 39.10 | 25.27 | 20.90 |
| | 2.11 ppm $NaAlO_2$ | 120 | 10.07 | 59.05 | 50.15 | 40.85 |
| Comparative | KNP with Etch | 0 | 0.64 | 8.18 | 8.82 | 0.00 |
| Example I | Protection | 24 | 4.72 | 27.55 | 23.44 | 19.37 |
| | | 48 | 7.73 | 42.00 | 40.91 | 33.82 |
| | | 120 | 12.70 | 62.95 | 66.83 | 54.77 |

As shown in Table 9, glassware exposed to the compositions of Examples 22 and 23 including either a soluble lithium salt or a combination of a soluble lithium salt and a soluble aluminum salt, respectively, had reduced etching compared to glassware exposed to a commercially available product, Comparative Example I. In particular, after 24 hours, the amount of etching on glassware washed with the composition of Example 22 was reduced by about 70.05% when compared to the amount of etching resulting from washing with the composition of Comparative Example I. After 24 hours, the amount of etching on glassware washed with the composition of Example 23 was reduced by over 61.95% when compared to the amount of etching resulting from washing with the composition of Comparative Example I.

After about 48 hours, the amounts of etching of the glassware washed with the compositions of Examples 22 and 23 were reduced by about 39.01% and 38.23%, respectively, when compared to the amount of etching resulting from washing with the composition of Comparative Example I. After about 120 hours, the amounts of etching of the glassware washed with the compositions of Examples 22 and 23 were reduced by about 28.88% and about 24.96%, respectively, when compared to the amount of etching resulting from washing with the composition of Comparative Example I.

Because the etch protection system used with the KNP contained aluminate and calcium salts, lithium and aluminate were indirectly included in the composition.

Examples 24 and 25 and Comparative Example J

A plurality of other warewashing compositions that included the corrosion inhibitor of the present invention in combination with a commercially available detergent were tested according to the method described above to determine their ability to reduce etching of glassware. In particular, the effect of using sodium aluminate 45% in combination with 25 ppm LithSil was tested. The composition of Example 24 included Kiseki No Phosphate (KNP) with no Etch Protection and 4.4 ppm LiOH (2.745 ppm $Li_2O$). The composition of Example 25 included KNP with no Etch Protection, 25 ppm LithSil (0.625 ppm $Li_2O$ and 5.125 ppm $SiO_2$) $Li_2SiO_3$ and 2.11 ppm sodium aluminate 45% (0.25 ppm active sodium aluminate).

The composition of Comparative Example J included KNP with no Etch Protection.

Table 10 lists the warewashing composition, the number of hours the glassware was exposed to the warewashing composition at 160° F., the average parts per million (ppm) of calcium and silicon detected, the total amount of calcium and silicon and the total amount of silicon.

TABLE 10

| | Warewashing Composition | Time at 160° F. | Average Calcium (ppm) | Average Silicon (ppm) | Silicon Calcium Total | Silicon Total ($T - T_0$) |
|---|---|---|---|---|---|---|
| Example 24 | KNP with no Etch Protection + 25 ppm LithSil | 0 | 0.50 | 16.55 | 17.05 | 0.00 |
| | | 24 | 5.81 | 38.95 | 27.08 | 4.35 |
| | | 48 | 8.75 | 55.65 | 47.35 | 16.00 |
| | | 96 | 13.62 | 75.15 | 71.75 | 33.35 |
| Example 25 | KNP with no Etch Protection + 25 ppm LithSil and 2.11 ppm $NaAlO_2$ | 0 | 0.50 | 21.00 | 21.50 | 0.00 |
| | | 24 | 1.54 | 25.35 | 5.39 | 22.40 |
| | | 48 | 4.19 | 37.00 | 19.69 | 39.10 |
| | | 96 | 8.70 | 54.35 | 41.55 | 58.60 |
| Comparative Example J | KNP with no Etch Protection | 0 | 0.50 | 10.70 | 11.20 | 0.00 |
| | | 24 | 5.25 | 25.85 | 19.90 | 15.15 |
| | | 48 | 8.48 | 48.50 | 45.78 | 37.80 |
| | | 96 | 13.25 | 67.50 | 69.55 | 56.80 |

As shown in Table 10, glassware exposed to the composition of Example 24 including a soluble lithium salt had substantially similar reduced etching compared to glassware exposed to a commercially available product, Comparative Example J. By contrast, glassware exposed to the composition of Example 25 including a soluble lithium salt and a soluble aluminum salt had substantially reduced etching compared to glassware exposed to a commercially available product, Comparative Example F. In particular, after 24 hours, the amount of etching on glassware washed with the composition of Example 24 was substantially similar to the amount of etching resulting from washing with the composition of Comparative Example F. After 24 hours, the amount of etching on glassware washed with the composition of Example 25 was reduced by about 72.91% when compared to the amount of etching resulting from washing with the composition of Comparative Example F.

Similarly, after about 48 and 96 hours, the amounts of etching of the glassware washed with the composition of Example 15 were substantially similar to the amounts of etching of the glassware washed with the composition of Comparative Example D. By contrast, after about 48 and 96 hours, the amounts of etching of the glassware washed with the composition of the composition of Example 16 were reduced by about 56.99% and about 40.26%, respectively, when compared to the amount of etching resulting from washing with the composition of Comparative Example F.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The invention claimed is:

1. A warewashing detergent composition comprising:

(a) between about 5% by weight and 75% by weight of an alkalinity source; and (b) between about 0.1% by weight and 2.5% by weight of a glass corrosion inhibitor comprising a soluble lithium salt and at least one of a soluble aluminum salt and a soluble silicate salt, wherein if a soluble aluminum salt is present, the soluble aluminum salt and the soluble lithium salt are present in an amount sufficient to provide a weight ratio of soluble aluminum salt to soluble salt of between about 410:1 and about 1:10, and wherein if a soluble silicate salt is present, the soluble silicate salt and the soluble lithium salt are present in an amount sufficient to provide a weight ratio of soluble silicate salt to soluble lithium salt of between about 40:1 and about 1:40.

2. The warewashing detergent composition of claim 1, wherein if a soluble aluminum salt and a soluble silicate salt are present, the soluble aluminum salt, the soluble silicate salt, and the soluble lithium salt are present in an amount sufficient to provide a weight ratio of soluble aluminum salt to soluble silicate salt to soluble lithium salt of between about 10:40:1 and about 4:1:40.

3. The warewashing detergent composition of claim 1, wherein if a soluble aluminum salt is present, the soluble aluminum salt and the soluble lithium salt are present in an amount sufficient to provide a weight ratio of soluble aluminum salt to soluble lithium salt of between about 4:1 and about 1:3, wherein if a soluble silicate salt is present, the soluble silicate salt and the soluble lithium salt are present in an amount sufficient to provide a weight ratio of soluble silicate salt to soluble lithium salt of between about 1:20 and about 1:15; and wherein if a soluble aluminum salt and a soluble silicate salt are present, the soluble aluminum salt, the soluble silicate salt, and the soluble lithium salt are present in an amount sufficient to provide a weight ratio of soluble aluminum salt to soluble silicate salt to soluble lithium salt of between about 1:1:17.8 and about 1.08:1:17.7.

4. The warewashing detergent composition of claim 1, wherein the soluble aluminum salt is selected from the group consisting of: sodium aluminate, potassium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum lithium sulfate, aluminum phosphate and mixtures thereof.

5. The warewashing detergent composition of claim 1, wherein the soluble lithium salt is selected from the group consisting of: lithium hydroxide, lithium chloride, lithium sulfate, lithium nitrate, lithium iodide, lithium thiocyanate, lithium fluorosilicate, lithium dichromate, lithium chlorate, sodium lithiumate, lithium gluconate, lithium acetate, lithium benzoate, lithium citrate, lithium lactate, lithium formate, lithium bromate, lithium bromide, lithium fluoride, lithium fluosilicate, lithium silicate, lithium salicylate and mixtures thereof.

6. The warewashing detergent composition of claim 1, wherein the soluble silicate salt is selected from the group consisting of: lithium metasilicate, sodium metasilicate, potassium metasilicate, sodium orthosilicate, potassium orthosilicate and mixtures thereof.

7. The warewashing detergent composition of claim 1, wherein the warewashing detergent composition comprises between about 0.2% by weight and about 2.0% by weight corrosion inhibitor.

8. The warewashing detergent composition of claim 1, further comprising a cleaning agent.

9. The warewashing detergent composition of claim 8, wherein the warewashing detergent composition comprises between about 0.5% by weight and about 20% by weight cleaning agent.

10. The warewashing detergent composition of claim 1 wherein the alkalinity source is selected from the group consisting of sodium hydroxide, sodium carbonate, potassium carbonate, sodium bicarbonate, potassium bicarbonate, sodium sesquicarbonate, potassium sesquicarbonate and mixtures thereof.

11. A method for using a warewashing detergent composition, the method comprising:

(a) diluting a warewashing detergent composition with water at a dilution ratio of at least about 20:1 water to warewashing detergent composition to form a use solution, wherein the warewashing detergent composition comprises:

(i) between about 0.5% by weight and about 20% by weight cleaning agent;

(ii) between about 5% by weight and 75% by weight of an alkalinity source; and (iii) between about 0.1% by weight and 2.5% by weight of a glass corrosion inhibitor, the corrosion inhibitor comprising a soluble lithium salt and at least one of an soluble aluminum salt and a soluble silicate salt; and (b) washing glassware with the use solution in an automatic dishwashing machine, wherein if a soluble aluminum salt is present, the soluble aluminum salt and the soluble lithium salt are present in an amount sufficient to provide a weight ratio of soluble aluminum salt to soluble salt of between about 410:1 and about 1:10, and wherein if a soluble silicate salt is present, the soluble silicate salt and the soluble lithium salt are present in an amount sufficient to provide a weight ratio of soluble silicate salt to soluble lithium salt of between about 40:1 and about 1:40.

12. The method of claim 11, wherein the warewashing detergent composition is provided as a solid.

13. The method of claim 11, wherein the alkalinity source is selected from the group consisting: of sodium hydroxide, sodium carbonate, potassium carbonate, sodium bicarbonate, potassium bicarbonate, sodium sesquicarbonate, potassium sesquicarbonate and mixtures thereof.

14. The method of claim 11, wherein the soluble aluminum salt is selected from the group consisting of: sodium aluminate, potassium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum lithium sulfate, aluminum phosphate and mixtures thereof.

15. The method of claim 11, wherein the soluble lithium salt is selected from the group consisting of: lithium hydroxide, lithium chloride, lithium sulfate, lithium nitrate, lithium iodide, lithium thiocyanate, lithium fluorosilicate, lithium dichromate, lithium chlorate, sodium lithiumate, lithium gluconate, lithium acetate, lithium benzoate, lithium citrate, lithium lactate, lithium formate, lithium bromate, lithium bromide, lithium fluoride, lithium fluosilicate, lithium silicate, lithium salicylate and mixtures thereof.

16. The method of claim 11, wherein the soluble silicate salt is selected from the group consisting of lithium metasilicate, sodium metasilicate, potassium metasilicate, sodium orthosilicate, potassium orthosilicate and mixtures thereof.

17. A solid detergent composition formed by the process comprising:

combining a glass corrosion inhibitor with an alkalinity source, wherein the glass corrosion inhibitor comprises soluble lithium salt, at least one of a soluble aluminum salt and a soluble silicate salt to form a mixture; and forming a solid detergent composition from the mixture, wherein the solid detergent composition comprises between 0.1 and 2.5 wt % of the corrosion inhibitor, wherein if a soluble aluminum salt is present, the soluble aluminum salt and the soluble lithium salt are present in an amount sufficient to provide a weight ratio of soluble aluminum salt to soluble salt of between about 410:1 and about 1:10, and wherein if a soluble silicate salt is present, the soluble silicate salt and the soluble lithium salt are present in an amount sufficient to provide a weight ratio of soluble silicate salt to soluble lithium salt of between about 40:1 and about 1:40.

18. A use solution for washing glassware, the use solution comprising:

an alkalinity source; and between about 0.01 ppm and about 300 ppm of a glass corrosion inhibitor comprising a soluble lithium salt and at least one of a soluble aluminum salt and a soluble silicate salt;

wherein the use solution has a pH of at least about 8, and wherein if a soluble aluminum salt is present, the soluble aluminum salt and the soluble lithium salt are present in an amount sufficient to provide a weight ratio of soluble aluminum salt to soluble salt of between about 410:1 and about 1:10, and wherein if a soluble silicate salt is present, the soluble silicate salt and the soluble lithium salt are present in an amount sufficient to provide a weight ratio of soluble silicate salt to soluble lithium salt of between about 40:1 and about 1:40.

19. The use solution of claim 18, wherein if a soluble aluminum salt and a soluble silicate salt are present, the soluble aluminum salt, the soluble silicate salt, and the soluble lithium salt are present in an amount sufficient to provide a weight ratio of soluble aluminum salt to soluble silicate salt to soluble lithium salt of between about 10:40:1 and about 4:1:40.

20. The use solution of claim 18, wherein the soluble aluminum salt is selected from the group consisting of: sodium aluminate, potassium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum lithium sulfate, aluminum phosphate and mixtures thereof.

21. The use solution of claim 18, wherein the soluble lithium salt is selected from the group consisting of: lithium hydroxide, lithium chloride, lithium sulfate, lithium nitrate, lithium iodide, lithium thiocyanate, lithium fluorosilicate, lithium dichromate, lithium chlorate, sodium lithiumate, lithium gluconate, lithium acetate, lithium benzoate, lithium citrate, lithium lactate, lithium formate, lithium bromate, lithium bromide, lithium fluoride, lithium fluosilicate, lithium silicate, lithium salicylate and mixtures thereof.

22. The use solution of claim 18, wherein the soluble silicate salt is selected from the group consisting of: lithium metasilicate, sodium metasilicate, potassium metasilicate, sodium orthosilicate, potassium orthosilicate and mixtures thereof.

* * * * *